United States Patent [19]

Hager

[11] 4,088,108

[45] May 9, 1978

[54] MULTIPLE CAPACITOR MEANS IGNITION SYSTEM

[75] Inventor: James R. Hager, Minnetonka, Minn.

[73] Assignee: Brunswick Corporation, Skokie, Ill.

[21] Appl. No.: 650,418

[22] Filed: Jan. 19, 1976

[51] Int. Cl.[2] ..... F02P 3/06; F02P 1/08

[52] U.S. Cl. ..... 123/148 CC

[58] Field of Search ..... 123/148 E, 148 CB, 148 CC

[56] References Cited

U.S. PATENT DOCUMENTS

| | | | |
|---|---|---|---|
| 3,566,188 | 2/1971 | Minks | 123/148 CC |
| 3,704,397 | 11/1972 | Crouch et al. | 123/148 CC |
| 3,805,759 | 4/1974 | Fitzner | 123/148 CC |
| 3,937,200 | 2/1976 | Sleder et al. | 123/148 CC |

*Primary Examiner*—Samuel W. Engle
*Assistant Examiner*—Thomas H. Webb
*Attorney, Agent, or Firm*—Andrus, Sceales, Starke & Sawall

[57] ABSTRACT

A four cylinder, two-cycle internal combustion engine for an outboard motor includes a pair of energy storage power capacitors. An engine driven alternator produces a generally sine wave output voltage having one-half cycle connected to charge one capacitor and the opposite half-cycle connected to charge the second capacitor by a suitable diode steering network. The output voltage frequency is greater than the firing frequency and a plurality of voltage cycles provide for charging of the capacitors to the desired level. A separate trigger capacitor is provided. The trigger capacitor is coupled to be charged from the main alternator through a low impedance network and additionally from the main capacitor charging circuit through a high impedance network which may also function as a safety circuit means. Each capacitor is recharged by a plurality of half-cycles and during such period of engine revolution the alternate capacitor is being finally charged and discharged. The safety circuit means provide for relatively minute or slow discharging of the capacitor means between cycles and thereby essentially fully discharge the capacitor means when the system is turned off and thus prevent maintaining of dangerously high voltages in the system at turn-off.

21 Claims, 2 Drawing Figures

MULTIPLE CAPACITOR MEANS IGNITION SYSTEM

BACKGROUND OF THE INVENTION

This invention relates to a capacitor discharge pulse system and particularly a capacitor discharge ignition system supplying high voltage pulses for firing of an internal combustion engine and the like.

In the driving of pulsed loads, a capacitor discharge system may be employed to establish appropriate high voltage pulse energy to the load. The capacitor is charged to the desired voltage level from any suitable source and then discharged into the load. For example, internal combustion engines used in an outboard motor, other recreational or non-recreational vehicle and the like, may advantageously operate with capacitor discharge ignition systems. The capacitor is suitably charged from a battery-converter unit or alternatively from a small alternator-rectifier unit driven in synchronism with the engine. A particularly satisfactory capacitor discharge ignition system for a multiple cylinder internal combustion engine is shown in U.S. Pat. No. 3,805,759 which issued Apr. 23, 1974, to Arthur O. Fitzner. In that system, an alternator is provided to charge a main firing capacitor which is discharged to the spark plugs through individual discharge circuits, each including a controlled rectifier or other gated switch device. The main pulse charging alternator is preferably constructed with separate high speed and low speed charging windings for regulated charging of the capacitor over the normal speed range and establish optimum operation of the engine. A separate trigger pulse generator has distributed trigger windings which are connected to sequentially fire individual controlled rectifiers in the discharge circuits for each of the spark plugs and thereby provide proper time spaced discharge of the capacitor to the appropriate spark plug for firing of the engine.

Although such systems have been widely employed and have particularly provided a highly improved and practical, commercial ignition system in two-cycle internal combustion engines for marine drives and the like, optimum engine ignition has not always been obtained. Problems of misfiring have been encountered in the higher numbered multiple cylinder two-cycle engines such as those with four cylinders and above, particularly at higher speeds.

SUMMARY OF THE PRESENT INVENTION

The present invention is particularly directed to a simple and reliable improvement in a capacitor pulse forming system to establish and maintain high energy output at relatively high speed range such as encountered in a two-cycle internal combustion engine having a plurality of cylinders. Generally, in accordance with the present invention, a plurality of energy storage capacitor means are interconnected to be sequentially and alternately charged from different portions of the output of a charging source such as an alternator means. More particularly, the conventional ignition alternator produces a generally sine wave output voltage. During one-half cycle of the alternator output, circuit means connect the output to charge one capacitor means and while the other or opposite half-cycle is connected to charge the second capacitor means.

In accordance with a practical feature of the present invention, suitable rectifying means interconnect the alternator source to a pair of capacitor means to charge each capacitor on a plurality of polarity related alternate half-cycles and hold such charge for subsequent firing.

In a unique embodiment of this present invention, each capacitor means is recharged for a plurality of cycles of the alternator output during which period the alternate capacitor means is finally discharged. Thus, as applied to a four cylinder, two-cycle outboard ignition system four pulses per engine revolution are required. With the present invention, a pair of capacitor means are recharged and discharged twice per engine revolution thereby doubling the time available for charging of each capacitor means and permitting charging to the desired level to maintain an essentially accurately regulated power supply for firing of the internal combustion engine.

In another aspect and feature of a unique embodiment, safety circuit means provide for relatively minute or slow discharging of the power capacitor means between cycles. The additional circuit means function to essentially fully discharge the capacitor means when the system is turned off and thus prevent maintaining of dangerously high voltages in the system at turn-off.

In a further novel feature and construction, the power capacitor discharging means employs trigger capacitor means for firing of main discharge control switch means. The trigger capacitor means is coupled to be charged from the main power source alternator through a low impedance network and additionally through an additional high impedance network coupled to the charging circuit of the power capacitor means. In a further aspect of the invention, the high impedance network functions as the safety circuit means for discharging of the power capacitor means.

More particularly, in a particularly practical and novel construction, an alternator includes a high speed coil and a low speed coil connected through a diode rectifier network to a pair of capacitors. The diode rectifier network steers the positive half-cycle power to the one capacitor and the negative half-cycle power to the second capacitor. A trigger power capacitor is connected to the output of the alternator through a voltage dividing resistor-diode network, which is a relatively low impedance, to charge the trigger capacitor from both half-cycles of the alternator to an appropriate firing voltage level. An auxiliary high resistance network is provided between the main firing capacitors and the trigger capacitor. At low speed, the time constant of the network provides significant charging current to the trigger capacitor. At high speed, the time constant of the network is so long as to effectively open the circuit and thereby maintain charging through the voltage dividing resistor-diode network. A single triggering capacitor can thus be employed to effect the sequential firing of the cylinders. The single trigger capacitor eliminates possible undesired crossfiring caused by RFI (radio frequency current) signals generated when a desired cylinder is fired. Thus, the RFI signal may be sensed by the trigger coils and develop a signal sufficient to turn-on the discharge circuit to another cylinder. With a single triggering capacitor, however, the triggering capacitor is essentially, completely discharged at the time the RFI signal occurs and thus eliminates any such firing.

The auxiliary or high resistance network also functions to bleed the main firing capacitors when the system is turned off. This minimizes the danger of creating a high voltage condition after turn-off of the system, with the corresponding danger of electrical shock. An isolating diode is also preferably connected between the low impedance level charging network and the high impedance auxiliary network to ensure holding of the charge on the trigger capacitor as the charging voltage drops to the lower level during each half-cycle. This further contributes to optimum charging of the main firing capacitors and the trigger capacitor. The charge may therefore be maintained under operation conditions and removed under off conditions.

The present invention has been found to provide a relatively simple and inexpensive ignition circuit for reliable triggering of multiple cylinder engines particularly of a two-cycle construction over a wide speed range. The invention is particularly adapted to modification of presently existing capacitor discharge ignition systems which have been found to be desirable for multiple cylinder high speed outboard motor drives.

BRIEF DESCRIPTION OF THE DRAWING

The drawing furnished herewith illustrates a preferred construction of the present invention in which the above advantages and features are clearly disclosed, as well as others, which will be readily understood from the following description.

In the drawing:

FIG. 2 is a graphical illustration of the charging and discharging of the capacitor ignition system shown in FIG. 1.

DESCRIPTION OF THE ILLUSTRATED EMBODIMENT

Figure 1:
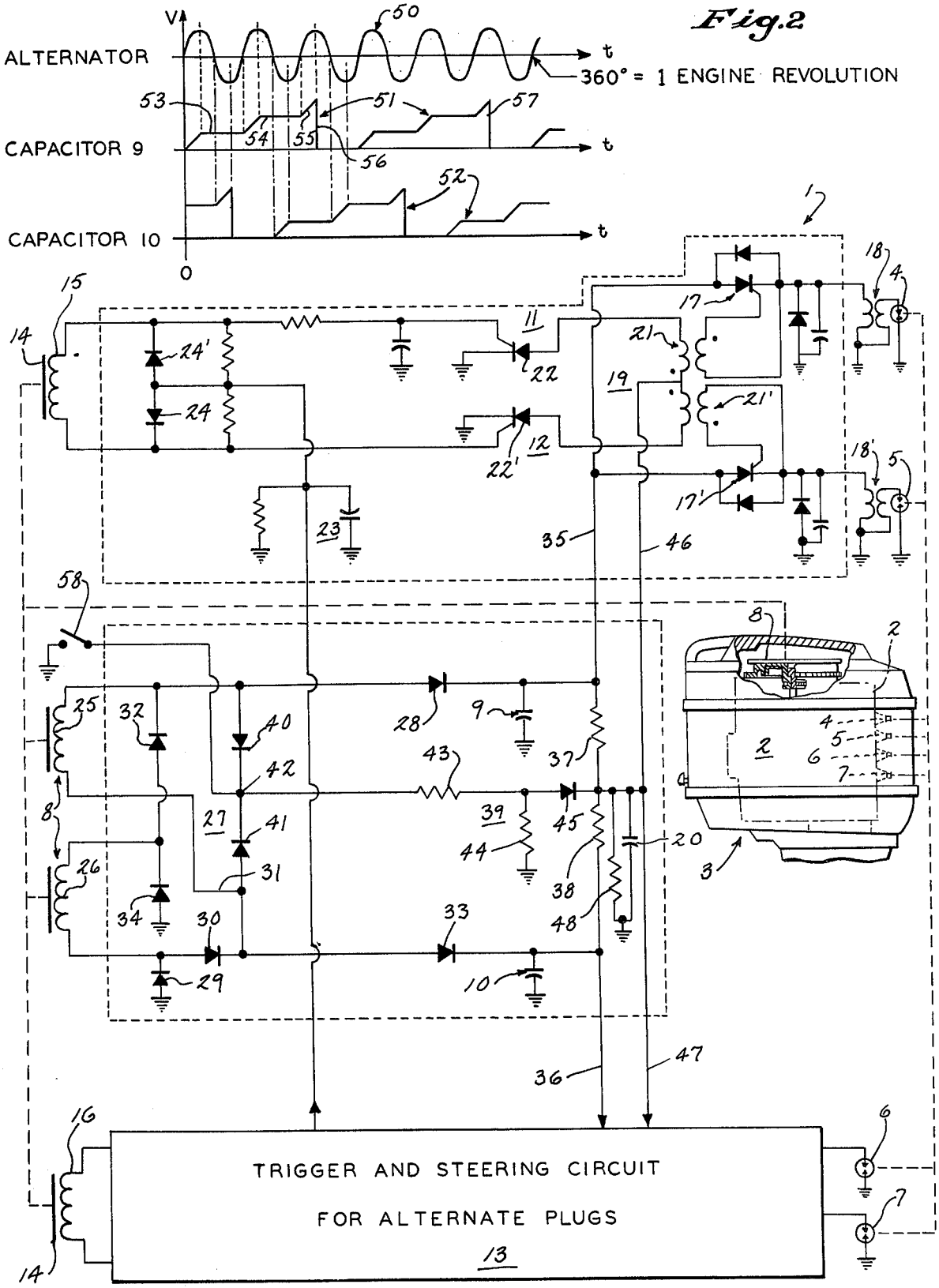
FIG. 1 is a schematic circuit diagram for a capacitor discharge ignition system constructed in accordance with the present invention and applied to an alternator driven capacitor discharge ignition system for an outboard motor drive.

Referring to the drawing, the illustrated embodiment of the present invention is a capacitor discharge ignition circuit 1 for a four cylinder, two-cycle internal combustion engine 2 forming a part of an outboard motor 3, the power head of which is partially shown. The ignition system 1 is separately schematically shown and the four spark plugs 4, 5, 6 and 7, one for each of the cylinders, is also separately shown as part of the circuit 1. In the illustrated embodiment of the invention, a main alternator 8 is coupled to and driven in synchronism with the engine 2. The alternator 8 constitutes the source of firing power for the internal combustion engine and is generally connected to alternately and repetitively charge a first and a second main firing capacitor 9 and 10. Each of the capacitors 9 and 10 is connected through individual discharge circuits to be several spark plugs 4–7 to form a distributorless and contactorless ignition system. Each of the discharge circuits is similarly constructed and in the illustrated embodiment circuits 11 and 12 for the two spark plugs 4 and 5 are shown in detail and will be briefly described hereinafter and circuits for the third and fourth spark plugs 6 and 7 are shown in an appropriately labeled block 13 for purposes of simplicity of illustration. Such circuits will be a duplicate of that illustrated for the first two spark plugs. Generally, the illustrated discharge circuit or system is similar to that disclosed in U.S. Pat. No. 3,715,650 which issued Feb. 6, 1973 to James R. Draxler and entitled "PULSE GENERATOR FOR IGNITION SYSTEMS," wherein a separate triggering generator 14 is provided and includes a pair of trigger coils 15 and 16 with the opposite ends of each of the trigger coils 15 and 16 connected to provide firing of one of the pair of discharge circuits 11–12 and 13 as follows.

The alternator 8 and the trigger generator 14 are shown generally mounted to the upper end of the engine. They may conveniently be constructed as shown in the previously identified U.S. patent or may be completely separate units.

More particularly, referring to discharge circuit 11, a main silicon controlled rectifier 17 is shown defining a gated switch means which is connected in series with the output of a pulse transformer 18 to the corresponding main firing capacitor 9. Discharge circuit 12 is similarly connected to capacitor 9 in parallel with circuit 11.

In the illustrated embodiment of the invention, a pulse forming network 19 is connected to selectively supply triggering pulses to the gate circuits of the main control rectifiers 17 and 17' in response to the output form the associated coil 15 of the trigger generator 14. Power to fire the main controlled rectifiers 17 and 17' is derived from a common triggering capacitor 20 which as more fully developed hereinafter is also connected to be charged from the main alternator 8.

The pulse forming network 19 includes a first pulse transformer 21 having a primary winding which is connected in series with a pilot or auxiliary gated signal switch as a silicon controlled rectifier 22 across the triggering capacitor 20 and a secondary winding which is connected across the gate to cathode elements of the rectifier 17. The gate of rectifier 22 is connected to the one side of the trigger coil and the cathode is connected to the opposite side of the coil via ground and a bias stabilizing resistance capacitor network 23 and a diode 24 such as disclosed in U.S. Pat. No. 3,715,650.

The rectifier 22' is similarly connected to coil 15 via the common network 23 and a diode 24 to respond to an opposite polarity pulse from coil 15. The rectifier 22' has its gate connected to the opposite end coil to respond to the opposite polarity output of coil 15, and correspondingly fire rectifier 17'. Various stabilizing capacitors, diodes, resistors and the like are employed in the described trigger forming and discharge circuit in accordance with the above prior art as well as in accordance with usual standard design practice. As detail of the trigger generator 14 and the circuitry associated therewith does not form any significant part of the teaching of the present invention, and can be readily provided by usual design, no further description thereof is given.

As previously noted, the present invention is particularly directed to the multiple firing capacitors 9 and 10 and the interconnection thereof to a limited power supply such as an engine driven alternator 8 to provide a reliable power supply for firing of the engine in proper timing, and in the preferred embodiment of the invention illustrated, to the further novel combination with the common triggering capacitor 20 for the firing of the main discharge switch means.

In the illustrated embodiment of the invention, alternator 8 is shown as a dual winding unit having a low speed charging coil 25 and a high speed charging coil 26 which, in combination, provides a relatively flat output with speed. The alternator 8 preferably includes a multiple pole rotor **26*a*** such that the output is an alternating current producing a plurality of charging cycles between each firing of the engine as more fully described in the description of the operation of one particular construction. The coils are shown connected in parallel to a full wave rectifying network 27 to charge the capacitors 9 and 10 as follows.

The windings or coils 25 and 26 are shown with a positive polarity dot adjacent to the upper end thereof which for purposes of discussion will be defined as the positive half-cycle output of the alternator. During the opposite half-cycle of the alternator output, the opposite ends of the winding would be relatively positive which will be defined as the negative half-cycle. For purposes of discussion, the polarity of the windings will be assumed to be continuously in phase although in practice some phase shift may arise. Such, however, has not interfered with the functioning of the present invention.

During the positive half-cycle, capacitor 9 is charged as follows. The low speed winding 25 has the assumed positive end connected via a first dioe 28 to the top or positive side of the capacitor 9, the opposite side of which is connected to ground and returned to winding 25 through series diode 29 and 30. More particularly, the return diode 29 has its anode connected to ground and its cathode connected to the anode of a diode 30, the cathode of which is connected by a lead 31 directly to the lower side of the low speed charging winding 25 to complete the charging path for such coil. The high speed charging coil 26 has the assumed positive end connected in series with a diode 32 to the connection of the low speed charging coil 25 and the anode of diode 28 and thus it provides a charging path through the diode 32 and the diode 28 to the top side of the capacitor 9 with a ground return through the diode 29, the cathode of which is connected not only to the anode of 30 but directly to the opposite or assumed negative end of the high speed charging coil 26. Thus with the illustrated polarity, the low speed charging coil 25 and the high speed charging coil 26 provide currents in parallel to simultaneously charge the capacitor 9. The high-low speed charging characteristic will, in accordance with known theory, ensure essentially a generally flat capacitor voltage versus engine speed characteristic.

During the negative half-cycle, the polarity of the charging coils will reverse; with the illustrated lower or opposite ends thereof assuming a relative positive polarity with respect to the upper ends. With this polarity, the common diode 28 is back biased and the capacitor 9 is essentially isolated from the charging windings 25 and 26.

The opposite half of network 27 provides an alternate diode system which connects the windings 25 and 26 to charge capacitor 10 as follows.

Beginning again with the low speed charging winding 25, the lower end thereof is connected via connecting line 31, to the anode of a second common diode 33, the opposite side of which is connected to the top side of capacitor 10. The opposite side of the capacitor 10 is grounded and returned to the top side of the coil 25 through a forward biased return diode 34 in series with the second forward biased return diode 32 to the top side of the coil 25.

The high speed charging coil 26 similarly has its lower end, which is now at a relative positive potential, connected in series with the diode 30 and the common diode 33, to the top side of the capacitor 10. The ground return path is directly through the common return diode 34, the cathode of which is connected directly to the top side of the charging coil 26.

This circuit thus effectively defines a full wave rectification of the output of the two windings in parallel and with the postive half-cycle pulses directed or steered to charge the capacitor 9 and the relatively negative half-cycle directed or steered to charge the capacitor 10.

The top side of the capacitor 9 is connected to a common output line 35 connected to the anodes 17 and 17' of the two trigger steering circuit for spark plugs 4 and 5.

The top side of capacitor 10 is similarly connected to a common output line 36 to fire the alternate spark plugs 6 and 7 through the alternate trigger and steering circuit 13.

In operation, the trigger generator 14 and pulse forming networks 19 provide appropriately spaced firing or triggering signals to turn on the controlled rectifiers 17 and 17' to alternately discharge capacitors 9 and 10 and further to alternately discharge capacitor 9 to fire the spark plugs 4 and 5 and to alternately discharge capacitor 10 to fire spark plugs 6 and 7. The capacitors 9 and 10 are thus alternately charged and discharged to fire the spark plugs in a proper firing order which, as described, is spark plugs 4, 6, 5 and 7.

In the illustrated embodiment of the invention, the individual output lines 35 and 36 are shown similarly coupled through individual series connected resistors 37 and 38 forming a part of an auxiliary charging circuit for charging of the common triggering capacitor 20 in addition to a main charging network 39 connected to the main alternator 8. The resistors 37 and 38, as presently described, have a relatively high resistance value which serves to operatively isolate the two main capacitor discharge circuits for firing of the discharge circuits 11–12.

More particularly, the capacitor 20 is directly coupled to the low speed and high speed charging windings 25 and 26 through a low impedance network 39 for charging during both positive and negative half-cycles of the alternator 8. In particular, a diode 40 connects the input side of the diode 28 and thus the common charging line for capacitor 9 to the input of the low impedance network 39. A diode 41 similarly connects the common charging line for capacitor 10 to the low impedance network 39 at a common node 42. Thus during either half-cycle, the appropriate diode 40 or 41 will be biased to divert a portion of the current into the low impedance coupling network 39.

The low impedance network 39 includes a pair of resistors 43 and 44 connected in series between the common input node 42 and ground. Resistors 43 and 44 may be respectively of the order of 560K of 180K ohms. The common junction or node of the voltage dividing resistors is connected by a blocking diode 45 to the top side of the capacitor 20, the opposite side of which is connected to ground, and through the previously described diodes back to the windings 25 and 26.

The diode 45 not only blocks the discharge of the capacitor 20 through the low impedance network 39 but also holds the charge on the capacitor when the charging voltage drops during the low level portion of the charging cycle below the capacitor voltage. The diode 45 further serves to isolate the high impedance network of resistor 37 and 38 from the low impedance network 39.

The resistors 43 and 44 thus form a voltage divider to establish a predetermined voltage on capacitor 20 which stores sufficient energy to reliably and consistently fire the main output controlled rectifiers 17 and 17' of the steering circuits 11 and 12 and 13 to which it is connected as follows.

The top side of the capacitor 20 is connected directly by a coupling lead 46 to the common primary winding connection of the two triggering pulse transformer 21 and 21' of the steering circuits 11 and 12, and by a lead 47 to similar circuit in the unit 13.

When triggered coil 15 activates one of the pilot rectifiers 22 or 22' a corresponding discharge path for capacitor 20 is created through the primary winding of the pulse transformer 21 or 21'. A pulse is thereby applied to the gate of the corresponding rectifier 17 or 17' causing it to conduct and thereby rapidly discharge the capacitor 9 to appropriately fire the engine. When trigger coil 16 activates the alternate trigger and steering circuit, capacitor 10 is discharged to fire one of the spark plugs 6 or 7.

Applicant has found that at low speeds, the normal low impedance network 39 for capacitor charging may not reliably charge capacitor 20 to the desired level. The large resistors 37 and 38 couple the main charging capacitors 9 and 10 to the trigger capacitor 20 to provide the following auxiliary charging path which is effective particularly at low speeds. The resistor 37 directly connects the output line 35 from capacitor 9 to the input or top side of the capacitor 20. The resistor 38 similarly connects the output line 36 from capacitor 10 to the top side of the capacitor 20 during each half-cycle. A large resistor 48 which may be of the order of 10M ohms is connected across capacitor 20 and with resistors 37 and 38 defines a voltage divider. The large resistance of resistor 48 minimizes discharge current under normal operation and maintains the required voltage level on the capacitor 20 at low speeds. The resistors 37 and 38 will be on the order of 22 million ohms and inherently create a very long time constant. At low speeds the period of each half-cycle is such that significant additional charging of capacitor 20 occurs and contributes to reliable firing of the main rectifiers 17 and 17'. At high speeds, however, the additional charging paths have essentially no effect as a result of the high associated time constant.

The voltage dividing network of resistors 37 and 38 with the resistor 48 further defines a pair of discharge paths for relatively slowly discharging of the main firing capacitors 9 and 10 as well as the trigger capacitor 20. Now, when the engine is turned off, any one of the capacitors 9 and 10 and 20 might be fully or partially charged, with the main capacitors 9 and 10 particularly at a relatively high voltage. To maintain such capacitor charge condition could well present a very undesirable and dangerous high voltage condition. In the illustrated embodiment of this invention, the capacitors discharge slowly through the high resistance voltage dividin network to ground to essentially eliminate such conditions. Thus, although the resistors 37, 38 and 48 provide a long time constant relative to the normal period of the charging and discharging and with respect to the frequency of the alternator under normal engine operation, resistors, 37, 38 and 48 present a relatively short time constant with respect to the period of time after cutoff of the engine.

The operation of the illustrated embodiment of the invention as applied to the four cylinder, two-cycle engine is summarized, as follows, with reference to FIG. 2 which illustrates typical capacitor charging and discharging conditions for one revolution. For example, a four cylinder, two-cycle engine requires sequential firing of the four cylinders at ninety degree intervals. The alternator 8 may be constructed with three poles to generate six cycles per engine revolutions, as shown at 50 in FIG. 2. Although shows as a sine wave output for purposes of explanation, the output may, of course, not be a true sine wave. The output is an alternating output and is conveniently and accurately analyzed with the illustrated wave shape. Each positive half-cycle charges capacitor 9 until discharged and each negative half-cycle charges capacitor 10 until discharged, with the resulting capacitor voltage traces, as shown in FIG. 2, by trace 51 for capacitor 9 and by trace 52 for capacitor 10.

More particularly, in the illustration at zero degrees, the alternator 8 is beginning a positive half-cycle of its output, and the capacitor 9 is shown completely discharged. The storage capacitor 9 is charged during the positive charging half-cycle to peak level 53 and is held at that level during the balance of the half-cycle and the immediately following negative half-cycle. At the next positive half-cycle, the capacitor 9 is again charged to a further level 54. During the third positive half-cycle, the capacitor 9 is further charged. During this half-cycle, and particularly during the peak portion, the trigger coil 15 associated with the trigger and steering circuit 11 generates a pulse to the gate of rectifier 22 which turns on to rapidly discharge the charge on capacitor 9, as shown at 56, and fire the appropriate spark plug 5. Thus, the turn-on of rectifier 22 completes the circuit for capacitor 20 which discharges through the steering circuit via lead 46, and, as a result thereof, turns on rectifier 17 and thereby discharges the capacitor 9. The discharge of the capacitor 9 is shown occurring at the peak of the charging half-cycle. The capacitor 9 rapidly and exxentially instantaneously discharges through the appropriate pulse transformer 18.

The trigger rectifier 22 of circuit 11 rapidly resets as a result of the termination of the pulse from coil 16 and discharge of capacitor 20 and, in effect, eliminates turn-on to the just completed discharge circuit 11 for the capacitor 20 from the circuit. Thus, when capacitor 20 has discharged, rectifier 17 turns off and the firing cycle for spark plug 5 has been completed.

Capacitor 9 remains fully discharged for the trailing portion of the positive half-cycle and the following negative half-cycle and is again charged on the fourth, fifth and sixth positive half-cycles, being discharged during the sixth half-cycle as at 57. At the latter firing, however, the polarity output of coil 15 has reversed and rectifier 22' conducts to complete the discharge circuit to spark plug 5.

The spark plugs 4 and 5 are thereby fired at 180° intervals of each complete engine revolution.

During this period, capacitor 10 is similarly charged and discharged, as shown by traces 52. However, the firing pulses generated by the alternate trigger coil 16 are offset to firs spark plugs 6 and 7 90° after firing of spark plugs 4 and 5, respectively.

Capacitor 20 is again charged upon turn-off of rectifier 22 through the low impedance network 39, and depending upon the speed, more or less through the high impedance network resistors 37 and 38. Following firing of capacitor 9 to spark plug 4 and prior to the initiation of the next firing period at which fully charged capacitor 10 is to be discharged to spark plug 6, capacitor 20 is fully charged. The trigger coil 16 creates the proper polarity pulse and actuates pilot control rectifiers 22 in circuit 13 to initiate a similar firing cycle to spark plug 6, with capacitor 20 activating a main controlled rectifier 17 of circuit 13, which, in turn, operates to discharge the main firing capacitor 10, through the appropriate discharge circuit for firing of the appropriate spark plug 6. Again, the cycle will be such that the capacitor 20 will fully discharge and the discharge circuit reset as a result of the turn off of the fired rectifier 22. During this latter period, the capacitor 9 is, of course, charging, as shown in FIG. 2 and previously described.

The system will continue to cycle to create proper time spaced firing order for engine operation, with the repetitive sequence of firing being spark plugs 4, 6, 5 and 7.

At each firing of a spark plug 4–7, an RFI (radio frequency current) signal is created. This RFI signal may generate a trigger signal within the trigger generator coils 15 and 16 of a sufficiently level to fire or turn-on a rectifier 22 or 22' of another cylinder. However, at the time the RFI signal is generated, capacitor 20 has just been discharged and, consequently, there is no power supply for creating a turn-on pulse in the circuit of the rectifiers 22 and/or 22'. Consequently, the RFI signal cannot activate the firing circuit to another spark plug.

A kill switch 58 is shown connected to the input line to the low impedance network 39 and, in particular, to the junction of the common connected cathodes of diodes 40 and 41. The kill switch 58 provides for manual connection of such junction point to ground which positively grounds the output of both of the charging coils 25 and 26 through the single switch 58. With the illustrated polarity, the top side of the low charging coil 25 connects to ground through the diode 40 while the high speed coil 26 connects to ground through the diodes 32 and 40. In the presence of the opposite polarity, the low speed charging coil 25 connects to ground through the diode 41 while the high speed coil 26 connects to ground through the diode 30 and 41. Stopping of the engine is thus established from the single "kill" switch.

Applicant has found that the multiple storage capacitors charged during different portions of the alternator output cycle and the common trigger capacitor means significantly contributes to the reliable ignition by insuring sufficient time for each of the capacitor means to fully recharge and by insuring proper firing sequence for the engine. The present invention permits the use of a relatively simple and reliable circuit for firing of multiple cylinder ignition internal combustion engines and the like.

Various modes of carrying out the invention are contemplated as being within the scope of the following claims, particularly pointing out and distinctly claiming the subject matter which is regarded as the invention.

I claim:

1. In an ignition system for an internal combustion engine having a power source producing an alternating current output including a positive polarity portion and a negative polarity portion, firing means for said engine, a plurality of separate power capacitor means connected to said firing means, a steering circuit including full wave rectifying means connecting the power source to said power capacitor means and polarized to conduct rectified positive polarity portions to first power capacitor means and rectified negative polarity portions to second power capacitor means for separately and sequentially charging of respective ones of said capacitor means to the same polarity and to a predetermined rectified potential, rectifier circuit means connected to said power source and to the trigger capacitor means for continuously supplying both said positive and negative polarity portions of said alternating current output to the trigger capacitor means for charging of said trigger capacitor means, and trigger means connecting the trigger capacitor means for alternately discharging said first and second power capacitor means.

2. The ignition system of claim 1 wherein said power source produces a plurality of output charging cycles between each discharge of the power capacitor means.

3. The ignition system of claim 1 for a four-cylinder, two-cycle engine, wherein said power source is an alternator establishing at least six complete charging cycles per engine revolution each of said cycles including a positive polarity half-cycle and a negative polarity half-cycle forming said polarity portions, and said trigger means being connected to discharge the power to capacitor means adjacent the peak of a corresponding charging half-cycle.

4. The ignition system of claim 3 wherein the output of the power source varies with engine speed and said circuit means includes a low impedance network to continuously supply power to the trigger capacitor means and a high impedance network to supply power to the trigger capacitor means at low engine speed.

5. The ignition system of claim 4 wherein each of said impedance networks is a resistive network.

6. In an ignition system for an internal combustion engine having an alternator having output windings producing an alternating output including a positive polarity portion and a negative polarity portion, a plurality of separate power capacitor means, a steering circuit including a full wave rectifying means connected between the output of the alternator and said plurality of power capacitator means and polarized to conduct rectified positive polarity portion of the windings to first selected power capacitor means and the rectified negative polarity portion to second selected power capacitor means, and circuit means for alternately discharging of said first and second capacitor means, a trigger capacitive means, rectifying circuit means connected to said alternator and to the trigger capacitive means to supply power to the capacitive means by both the positive and negative polarity portions of said alternating output, and discharge switch means controlled by said trigger capacitive means and connected in said circuit means for alternately discharging of said first and second power capacitor means.

7. The ignition system of claim 6 wherein said steering circuit includes diode means connecting the alternator to said capacitor means and polarized to conduct appropriate polarity portions.

8. The ignition system of claim 6 wherein said engine is a two-cycle, four-cylinder engine having a first pair of igniting means connected to the first selected capacitor means and a second pair of igniting means connected to the second selected capacitor means.

9. In a capacitor discharge ignition system for a multiple cylinder internal combustion engine including a main alternator providing an alternating output and a separate trigger generator providing time spaced trigger pulses, said alternator and generator being coupled to the engine and driven in synchronism therewith and having a plurality of individual firing circuits connect to the igniting means and divided into first and second groups, comprising a first main firing capacitor, a second main firing capacitor, a diode network connecting said alternator to charge the first main firing capacitor during the first half-cycle of the alternator, a second diode network connecting the source to charge the second main firing capacitor and charging thereof during the second alternate charging half-cycle of the alternator, a first discharge line connecting said first main firing capacitor to the first group of said firing circuits, and a second output line connecting the second main firing capacitor to the second group of main firing circuits, and discharge means responsive to the trigger generator to alternately discharge said capacitors and to sequentially discharge said capacitors to different ones of said igniting means in the interconnected group.

10. In the capacitor discharge ignition system of claim 9 wherein said discharge means includes a trigger capacitor having an output means connected to all of the firing circuits and selectively operable in response to the output of the trigger generator to fire one of the firing circuits, a low impedance voltage dividing network connected to said capacitor, and a rectifying steering network connected between the low impedance network and the alternator to charge the trigger capacitor.

11. In the capacitor discharge ignition system of claim 10 wherein said low impedance voltage dividing network includes a voltage dividing resistance means having an output connection including a diode means connected to one side of said trigger capacitor, a diode means connected between the one end of resistance means and the alternator and polarized to conduct the negative and positive half cycles of the alternator to charge the triggering capacitor.

12. In the capacitor discharge ignition system of claim 10, having a high impedance resistance network connected between the first and second main firing capacitors and the trigger capacitor to provide an auxiliary charging path to said trigger capacitor, said high impedance network providing a charging current at low engine speeds and having a relative high time constant to effectively eliminate said auxiliary charging paths during the high speed operation of the engine.

13. In the capacitor discharge ignition system of claim 12 wherein said high impedance resistance network includes individual resistors connected to the high potential side of the first and second main firing capacitors and a resistor connected in parallel with the trigger capacitor to provide a pair of auxiliary charging paths to said trigger capacitor.

14. In the capacitor discharge ignition system of claim 12 wherein said high impedance network provides a discharge path to said first and second main firing capacitors with the ignition system turned off.

15. In the ignition system of claim 12 wherein each of said main firing circuits includes a main control rectifier connected between a corresponding capacitor and the igniting means for controlling transfer of energy from the capacitor to the corresponding igniting means, circuit means including a pulse forming means having an input connected to said trigger capacitor and an auxiliary control rectifier means to selectively complete the circuit through said pulse forming means for discharging of the trigger capacitor through selected ones of the pulse forming means and thereby control the transfer of energy to the corresponding igniting means, said trigger generator means providing time space pulses to each of said auxiliary control rectifier means in a repetitive time based sequence for sequential activation of said discharge means.

16. A capacitor discharge ignition system, for a four-cylinder, two cycle internal combustion engine of an outboard motor, comprising a source alternator driven in synchronism with the engine and producing six output cycles per engine revolution, a first main firing capacitor means and a second main firing capacitor means, a full wave rectifying means having first circuit charging means connecting said first main firing capacitor means to said source for charging during a first polarity half-cycle of the alternator output, said rectifying means having a second circuit means connecting the second capacitor means to said source and providing charging thereof during the alternate polarity half-cycle of said source, said capacitor means being separately and sequentially charged to the same polarity and to a predetermined rectified potential, a capacitive trigger means for discharging of the capacitor means during a peak portion of every third charging half-cycle, and rectifying means connecting the trigger means to the power source for charging the capacitive trigger means from both polarities of the source.

17. The ignition system of claim 16 including a first main control switch means connected to said first capacitor means for discharging thereof, a second main firing control switch means connected to said second capacitor means for discharging thereof, said first and second control switch means being gated switches, said capacitive trigger means including a trigger capacitor means coupled to said main alternator source and charged during both output half-cycles thereof, second gates means connecting said trigger capacitor to discharge into one of said control switch means, and a trigger generator having a plurality of output coils connected to actuate said second gated means.

18. The ignition system of claim 17 wherein said second gated means includes a plurality of individual gated trigger switches, and said trigger generator being a permanent magnet generator generating opposite polarity output pulse signals in each of said coils, first of the trigger switches having a gate means connected to the first end of a trigger coil and second of the trigger switches having a gate means connected to the second end of a trigger coil.

19. A capacitor discharge ignition system, comprising an alternator power source, power capacitor means connected to be charged from said power source, a trigger capacitor means, a low impedance network connecting the trigger capacitor means to the power source, and a high impedance network connecting the trigger capacitor means to derive power from the charging circuit to the power capacitor means whereby said trigger capacitor means is provided with charging current through both of said networks.

20. The capacitor discharge ignition system of claim 19 wherein said high impedance network functions to continuously discharge said power capacitor means.

21. The capacitor discharge ignition system of claim 19 wherein said low impedance network includes a diode means preventing discharge of the capacitor means therethrough.

* * * * *